US012485331B2

(12) United States Patent
Wu

(10) Patent No.: US 12,485,331 B2
(45) Date of Patent: Dec. 2, 2025

(54) TWO PLAYER THREE IN ONE JUNIOR BASKETBALL GAME

(71) Applicant: Medal Sports (Taiwan) Corporation, Taipei (TW)

(72) Inventor: Shih-Hsia Wu, Shenzhen (CN)

(73) Assignee: Medal Sports (Taiwan) Corporation, Taipei (TW)

( * ) Notice: Subject to any disclaimer, the term of this patent is extended or adjusted under 35 U.S.C. 154(b) by 5 days.

(21) Appl. No.: 17/509,510

(22) Filed: Oct. 25, 2021

(65) Prior Publication Data

US 2022/0126182 A1 Apr. 28, 2022

Related U.S. Application Data

(60) Provisional application No. 63/105,574, filed on Oct. 26, 2020.

(51) Int. Cl.

| | |
|---|---|
| ***A63B 63/08*** | (2006.01) |
| ***A63B 63/00*** | (2006.01) |
| ***A63B 69/00*** | (2006.01) |

(52) U.S. Cl.

CPC ..... *A63B 63/083* (2013.01); *A63B 69/0071* (2013.01); *A63B 2063/001* (2013.01); *A63B 2210/50* (2013.01)

(58) Field of Classification Search

CPC ..... A63B 67/00; A63B 71/00; A63B 67/06; A63B 71/04; A63B 65/12; A63B 63/083;

(Continued)

(56) References Cited

U.S. PATENT DOCUMENTS 406,342 A * 7/1889 Dumont ..... A63B 67/06 273/402
1,439,199 A * 12/1922 Spilman ..... A63F 7/249 273/317.3

(Continued)

FOREIGN PATENT DOCUMENTS

CN 2407794 Y * 11/2000
CN 205626967 U * 10/2016

(Continued)

OTHER PUBLICATIONS

KR 200280503 Y1 (Year: 2002).*

(Continued)

*Primary Examiner* — Melba Bumgarner
*Assistant Examiner* — Amir A Klayman
(74) *Attorney, Agent, or Firm* — Prince Lobel Tye LLP

(57) ABSTRACT

A multi-game arcade-type apparatus includes a framework, a first goal assembly, a ball return chute, and a second goal assembly. The first goal assembly receives tossed balls in a first game and is attached to a support portion of the framework. The ball return chute includes a bed and sidewalls for collecting balls from the first goal assembly and is attached between the support portion and a foldable portion of the framework. The second goal assembly receives tossed bean bags tossed in a second game and is attached to the bed. A rectangular front-end frame attached to the foldable portion includes a moveable upper cross member. In a first lower position, the moveable upper cross member stops the returning balls of the first game. In a second higher position, the moveable upper cross member acts as part of a third goal assembly for ladder balls tossed in a third game.

6 Claims, 11 Drawing Sheets

(58) Field of Classification Search
CPC ..... A63B 69/0071; A63B 2063/001; A63B 2210/50
See application file for complete search history.

(56) References Cited

U.S. PATENT DOCUMENTS 1,574,201 A * 2/1926 Lynch ..... A63B 63/083 473/433
3,899,173 A * 8/1975 Zaris ..... A63F 7/0612 273/405
4,012,042 A * 3/1977 Blasingame ..... A63B 63/08 273/401
D284,599 S * 7/1986 Cochran ..... D21/305
4,905,996 A * 3/1990 Tallent ..... A63B 63/00 473/197
5,246,225 A * 9/1993 Matherne ..... A63B 69/0071 273/375
5,312,099 A * 5/1994 Oliver, Sr. ..... A63B 63/083 473/433
5,320,360 A * 6/1994 St. Pierre ..... A63F 9/0204 273/402
5,443,259 A * 8/1995 Segan ..... A63F 7/0612 273/123 A
5,803,841 A * 9/1998 Daskoski ..... A63B 69/0002 473/454
6,082,736 A * 7/2000 Barlow ..... A63D 3/02 273/317.1
6,083,124 A * 7/2000 Williams ..... A63B 71/022 473/421
6,149,152 A * 11/2000 Mancke ..... A63B 69/002 273/123 R
6,192,635 B1 * 2/2001 Zheng ..... A63B 9/00 52/143
6,481,451 B2 * 11/2002 Zheng ..... E04H 15/40 160/135
6,929,569 B1 * 8/2005 Wang ..... A63B 69/0071 473/483
7,090,596 B2 * 8/2006 David ..... A63B 63/00 473/439
7,198,273 B1 * 4/2007 Advocate ..... A63B 43/007 273/343
7,247,105 B2 * 7/2007 Huntsberger ..... A63B 57/357 473/433
7,328,902 B1 * 2/2008 White ..... A63B 63/00 273/343
7,351,168 B1 * 4/2008 Pannell ..... A63B 63/004 273/400
7,429,223 B2 * 9/2008 Dovrat ..... A63B 63/00 473/476
8,708,406 B1 * 4/2014 Powell ..... A47C 7/62 5/725
D736,321 S * 8/2015 Shadle ..... D21/302
9,950,230 B2 * 4/2018 Silva ..... A47C 7/624
10,201,736 B2 * 2/2019 Tsai ..... A63B 67/00
10,220,281 B2 * 3/2019 Luo ..... A63B 71/0605
10,314,403 B2 * 6/2019 Schmidt ..... A47C 1/14
10,603,559 B1 * 3/2020 Farley ..... A63B 69/0071
10,813,447 B2 * 10/2020 Tsai ..... A47B 25/00
11,278,781 B2 * 3/2022 Wang ..... A63B 71/023
11,344,777 B2 * 5/2022 Wang ..... A63B 63/083
2003/0030218 A1 * 2/2003 Zucchi ..... A63B 63/00 273/371
2005/0134000 A1 * 6/2005 Johnson ..... A63B 63/06 273/343
2008/0220913 A1 * 9/2008 Cosenza ..... A63B 67/06 473/476
2008/0252018 A1 * 10/2008 Chung ..... A63B 24/0021 273/402
2009/0051133 A1 * 2/2009 Oshiro ..... B62B 3/02 273/348
2009/0115136 A1 * 5/2009 Voden ..... A63B 21/0054 273/245
2010/0275641 A1 * 11/2010 Manner ..... A63F 9/0204 273/287
2012/0329580 A1 * 12/2012 Weitzner ..... A63F 13/213 473/415
2016/0023095 A1 * 1/2016 Nally ..... A63F 9/0208 273/343
2016/0144256 A1 5/2016 Lee
2016/0166068 A1 * 6/2016 Holzhauzer ..... A63B 67/06 297/16.1
2016/0192783 A1 * 7/2016 Kelly ..... E04H 15/50 135/96
2016/0287964 A1 * 10/2016 Jones ..... A63B 63/083
2017/0354855 A1 * 12/2017 Cullen ..... A63B 63/08
2018/0250567 A1 * 9/2018 Luo ..... A63F 7/0608
2018/0256954 A1 * 9/2018 Schmidt ..... A63B 63/08
2019/0030409 A1 * 1/2019 Von Bokel ..... A63B 67/002
2020/0086193 A1 * 3/2020 Lu ..... A63B 71/022
2020/0238143 A1 * 7/2020 Howell ..... A63B 67/06
2021/0260456 A1 * 8/2021 Lombardini ..... A63B 71/023
2023/0173360 A1 * 6/2023 Curtis ..... A63B 63/08 473/479

FOREIGN PATENT DOCUMENTS

KR 200280503 Y1 * 7/2002
KR 200374517 Y1 * 1/2005

OTHER PUBLICATIONS

KR 200374517 Y1 (Year: 2005).*
CN 205626967 U (Year: 2016).*
CN 2407794 Y (Year: 2000).*

* cited by examiner (PRIOR ART)

100

(PRIOR ART)

300

400

700

800

900

1000

TWO PLAYER THREE IN ONE JUNIOR BASKETBALL GAME

CROSS-REFERENCE TO RELATED APPLICATION

This U.S. Non-Provisional Patent Application claims the benefit of and priority to U.S. Provisional Patent Application Ser. No. 63/105,574 filed on Oct. 26, 2020, titled "Two Player Three In One Junior Basketball Game," the entire disclosure of which is hereby incorporated by reference.

BACKGROUND OF THE INVENTION

1. Field of the Invention

The disclosure herein relates to an apparatus for converting a foldable arcade-type device into a multi-game arcade-type device. More specifically, a second goal assembly is added to a ball return chute of an arcade-type device for a first ball-tossing game to allow the arcade-type device to be used for a second bean bag tossing game. Also, a moveable upper cross member is added to a rectangular front-end frame of the arcade-type device so that the moveable upper cross member can be moved to a higher position to act as part of a third goal assembly for receiving ladder balls in a third ladder tossing game.

2. Related Art

As described in U.S. Pat. No. 5,246,225 (hereafter the "'225 Patent"), many people enjoy sports either as a participant or as a spectator. Unfortunately, most sports require large spaces and are therefore played outdoors on large playing fields or indoors at large facilities. Thus, most people are unable to play and practice these sports at home. Accordingly, these sports are impractical and space prohibitive for most families. For example, it is not practical to construct large courts or playing fields within a home because of the required unobstructed floor space.

Due to the popularity of sports games and the skill required to play such games well, games derivative of sports such as basketball, football, baseball, and softball have been developed. Games that test a player's basketball shooting or ball-tossing skills are among the most popular and can be found at amusement parks, carnivals, and fairs. Typically, a player is given a certain number of shots or throws to score a predetermined number of baskets or hit a target in order to win a prize. Usually, an attendant is present to administer the game and distribute the prizes. Such games are usually outdoors, large, and not intended to be readily mobile.

In more recent years, there has been a trend to scale down the size of such sports game derivatives so that the game could move indoors into arcades. Such arcade games are typically coin-operated and permit the player a designated period of time to score as many baskets or hit as many targets as possible. Prizes or additional playing time may be awarded to the particularly skillful player who scores a predetermined number of baskets or points within the time period allowed. Such arcade games have become very popular, finding their way into bars, pizza parlors, and other places of amusement and entertainment.

Although arcade-style games of this type have been used in homes, generally such arcade-style sports games are not found within a home. This is because, heretofore, such arcade-style game devices were not intended for and do not address the space limitations presented by home-usage. For example, most homes have very limited floor space and relatively low ceilings. These arcade-style sports games that are known are deployed in a ready-to-play configuration that consumes valuable floor space. If a person wishes to reduce the amount of floor space used by the apparatus of the game, disassembly is required.

One known device that does address limitations presented by home-usage is the MD SPORTS™ 2-player arcade basketball game of Medal Sports Corporation of Taipei, Taiwan (hereinafter the "Exemplary Device"). This device is adaptable for indoor home-usage while still providing an arcade-type game. Hence, it provides an arcade-type sports game device that is easily foldable for storage and may be rapidly deployed into its ready-to-play configuration. Additionally, it provides a foldable arcade-type sports game device that stores in a substantially vertical position while resting on a stable base, thereby minimizing the amount of floor space occupied when the game is not in use. It can be transformed rapidly from its vertical storage disposition to its ready-to-play configuration without disassembly of any of its parts.

FIG. 1 is a perspective view 100 of the framework of the Exemplary Device that is adaptable for indoor home-usage while still providing an arcade-type game, upon which various embodiments may be implemented. Framework 1 of FIG. 1 includes support portion 11 and a foldable portion. Support portion 11 includes a freestanding vertical portion and does not move.

The foldable portion moves and folds with respect to support portion 11. The foldable portion includes U-shaped cross member 5, U-shaped extendable leg 13, curved supports 12, and telescopic poles 14. Each of telescopic poles 14 includes a support pole 141, a joint 143, and a sliding pole 144 that slides into joint 143.

Further, the Exemplary Device provides an arcade-type sports game device that enables head-to-head competition. It can electronically register the score and visually display the running score while simultaneously visually counting down the time during which made shots or tosses are counted.

FIG. 2 is a perspective view 200 of the Exemplary Device of FIG. 1 showing a goal assembly and a ball return chute attached to the framework, upon which various embodiments may be implemented. FIG. 2 shows goal assembly 2 and ball return chute 4 attached to framework 1. The goal assembly 2 includes a backboard 21, baskets 22A and 22B, ball sensors 23A and 23B, and an opening for a scoring device and scoreboard 24. During a game, basketballs are thrown toward baskets 22A and 22B. The scoring device and scoreboard tally scores or counts from ball sensors 23A and 23B. Two baskets 22A and 22B and ball sensors 23A and 23B allow head-to-head competition. The scoring device and scoreboard 24 may display the count and/or wirelessly transmits the count to an electronic device such as a portable electronic device. The ball sensors 23A and 23B may be electrically or wirelessly connected to the scoring device and scoreboard 24.

Ball return chute 4 includes bed 41 for returning basketballs to a game player and sidewalls 42 for directing rebounding balls to bed 41. Ball return chute 4 is attached at one end to support portion 11 of framework 1. Ball return chute 4 is attached at the other end of framework 1 to U-shaped cross member 5 of the foldable portion. An inset labeled "210" shows that the straight cross member 7 is also used to secure one end of the ball return chute 4 to the framework 1. The straight cross member 7 is threaded through a sleeve of the ball return chute 4 and bolted or screwed to the U-shaped cross member 5. The U-shaped cross member 5 and the straight cross member 7 form a rectangular front-end frame of the foldable portion of framework 1. This rectangular front-end frame also acts as a barrier for basketballs that return down ball return chute 4 during a game. As a result, the height of the rectangular front-end frame that includes the U-shaped cross member 5 and the straight cross member 7 is made less than the width of a maximum cross-section of a basketball (e.g., a standard size and/or otherwise dependent on hoop) or hoop.

FIG. 3 is a perspective view 300 of the Exemplary Device of FIG. 1 showing the goal assembly and the framework in the folded position, upon which various embodiments may be implemented. FIG. 3 shows that the support portion 11 of the framework 1 remains unchanged when the foldable portion is folded up towards the support portion 11. Similarly, because the goal assembly 2 is attached to the support portion 11, it also remains unchanged when the Exemplary Device is folded. The ball return chute is not shown in FIG. 3 but would be folded between support portion 11 and the foldable portion of framework 1. In other words, the ball return chute also folds. The inset labeled "310" shows that the foldable portion can be locked into place in the folded position using, for example, the latch 111 of the support portion 11.

FIGS. 1-3 show that the Exemplary Device provides a portable arcade-type sports game device for the home and also enables head-to-head competition. Unfortunately, however, the Exemplary Device is useful for only one type of sport or game. As a result, apparatuses and methods are needed for converting an arcade-type game device to a multi-game or multi-sports device.

To this end, the prior art has proposed convertible arcade-type game devices. For example, U.S. Pat. No. 7,247,105 describes further including a panel with an orifice beneath a backboard of a basketball arcade game to receive a ball such as a football, baseball, softball, and baseball. In addition, this patent includes a goal beneath the basketball ball return chute for a hockey puck, soccer ball, and golf ball. Similarly, U.S. Published App. No. 2008/0252018 describes an elongated backboard of a basketball game that includes target areas at which a football may be thrown. This application also includes a lower panel that has target areas at which a soccer ball can be kicked.

Finally, U.S. Published App. No. 2016/0144256 describes a rotatable goal arcade-type game device. The rotatable goal allows a user to select between 2, 3, 4, 5, 6, 7, or 8 different goals. These goals can be used during sports such as, but not limited to, basketball, baseball, softball, football, and bean-bag toss. Although the prior art includes apparatus for converting an arcade-type game device to a multi-game or multi-sports device, these devices typically require significant changes to the original game device or significantly more parts.

As a result, additional apparatuses and methods are needed to conveniently convert an arcade-type game device to a multi-game or multi-sports device by applying a minimal number of changes to the device and using a minimal amount of additional parts.

SUMMARY OF THE INVENTION

This section provides a general summary of the disclosure and is not to be interpreted as a complete and comprehensive listing of all of the objects, aspects, features and advantages associated with the present disclosure.

In accordance with one aspect of the disclosure, a foldable multi-game arcade-type apparatus is disclosed. The apparatus includes a framework, a first goal assembly, a ball return chute, and a second goal assembly.

The framework includes a support portion and a foldable portion. The first goal assembly receives balls tossed by a user in a first game. The first goal assembly is attached to the support portion of the framework.

The ball return chute includes a bed and two sidewalls for collecting balls from the first goal assembly and returning the collected balls to the user. The ball return chute is attached at a first end of the ball return chute to the support portion of the framework and is attached at a second end of the ball return chute to the foldable portion of the framework.

The second goal assembly receives bean bags tossed by the user in a second game. The second goal assembly is attached to or made part of the bed of the ball return chute.

In various embodiments, the second goal assembly includes a hole in the bed of the ball return chute. In various embodiments, the second goal assembly further includes a container attached to the hole for collecting bean bags received by the hole in the second game.

In various embodiments, the foldable multi-game apparatus further includes a rectangular front-end frame that is attached to the foldable portion of the framework. The rectangular front-end frame includes a lower cross member that attaches to the bed at the second end of the ball return chute and a moveable upper cross member that can move with respect to the lower cross member. The moveable upper cross member can move with respect to the lower cross member to at least two different positions thereby increasing or decreasing the height of the rectangular front-end frame while still maintaining a rectangular shape. In a first lower position of the at least two different positions, the moveable upper cross member stops the returning balls of the first game at the second end. In a second higher position of the at least two different positions, the moveable upper cross member acts as part of a third goal assembly for ladder balls tossed in a third ladder toss game.

In accordance with one aspect of the disclosure, a method for converting a foldable multi-game apparatus from a ball toss game to a ladder toss game is also disclosed. This method includes moving a moveable upper cross member of a rectangular front-end frame of a foldable multi-game apparatus from a first lower position that stops returning balls of a first ball-tossing game to a second higher position to act as part of a second goal assembly for ladder balls tossed in a second ladder toss game.

These and other features of the applicant's disclosure are set forth herein.

BRIEF DESCRIPTION OF THE DRAWINGS

The skilled artisan will understand that the drawings, described below, are for illustration purposes only. The drawings are not intended to limit the scope of the present disclosure in any way.

Figure 1:
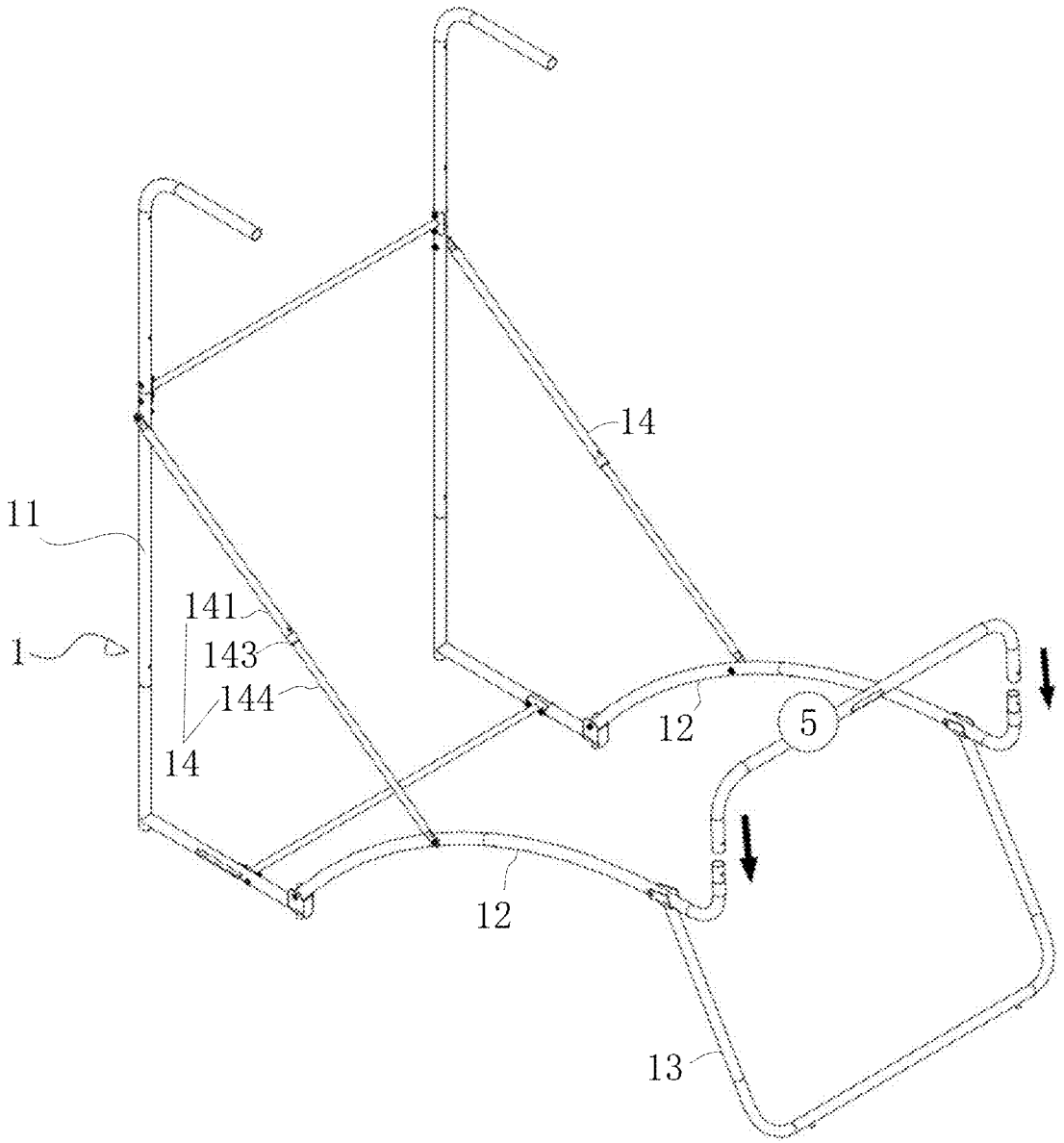
FIG. 1 is a perspective view of the framework of the Exemplary Device that is adaptable for indoor home-usage while still providing an arcade-type game, upon which various embodiments may be implemented.
Figure 2:
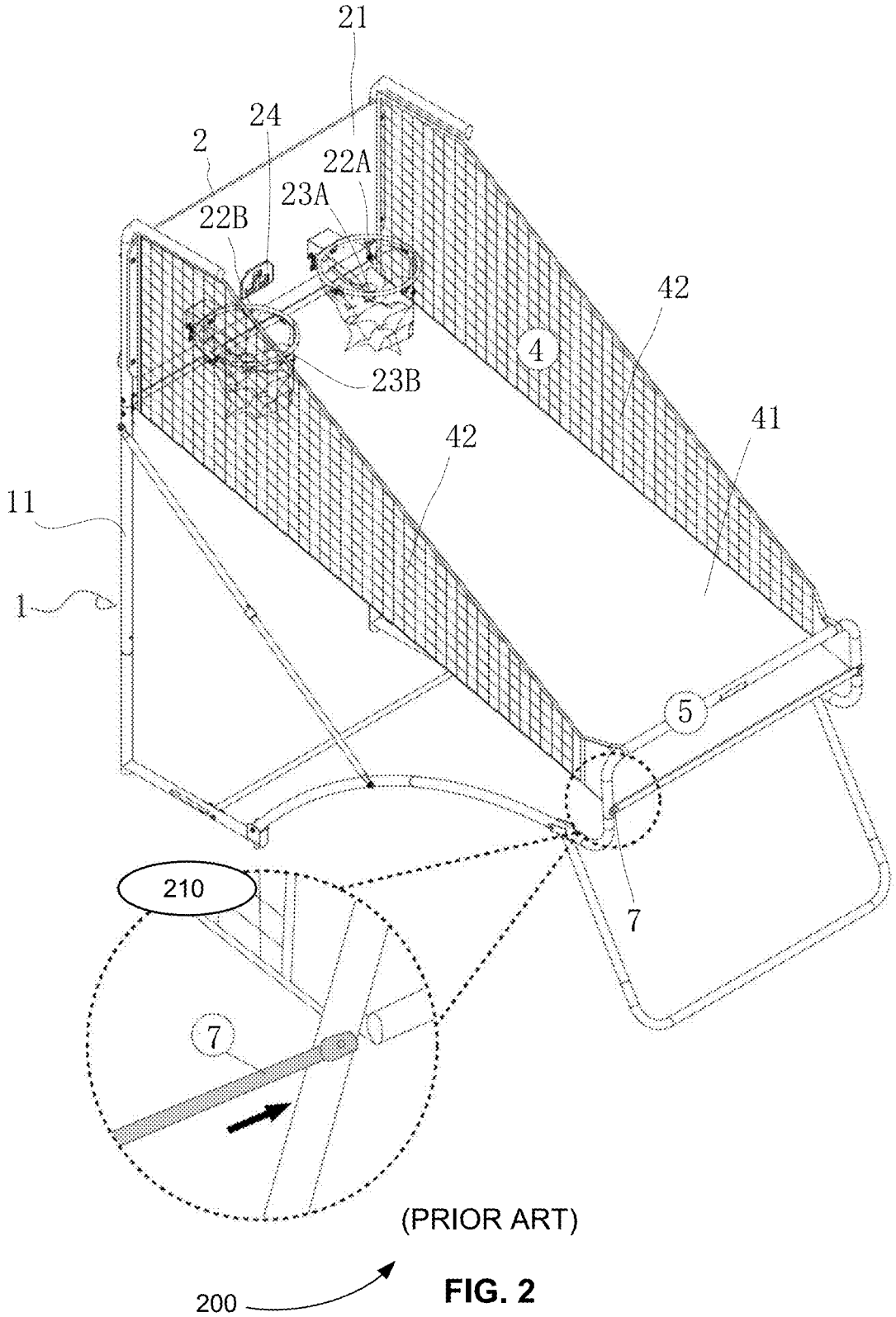
(PRIOR ART) FIG. 2
FIG. 2 is a perspective view of the Exemplary Device of FIG. 1 showing a goal assembly and a ball return chute attached to the framework, upon which various embodiments may be implemented.
Figure 3:
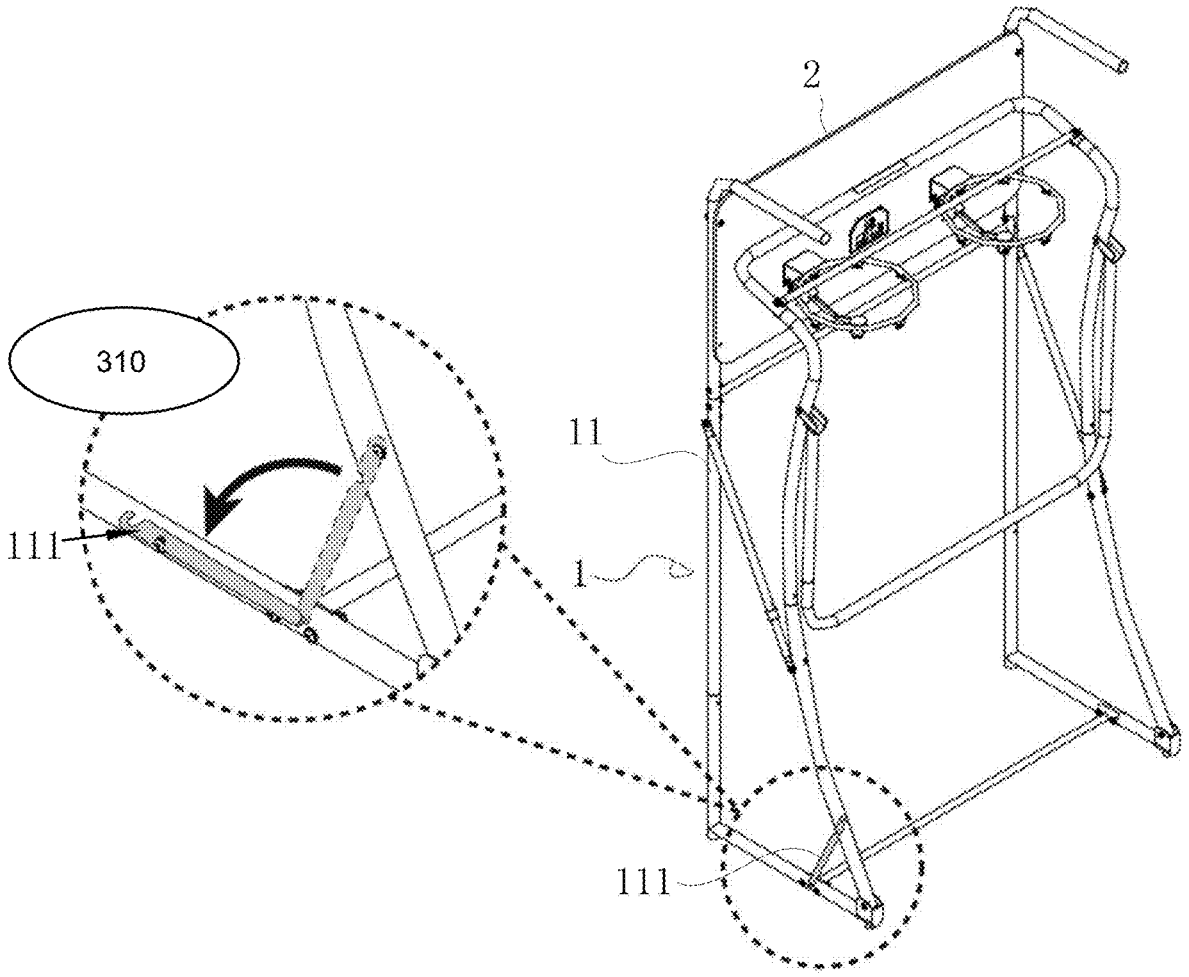
FIG. 3 is a perspective view of the Exemplary Device of FIG. 1 showing the goal assembly and the framework in the folded position, upon which various embodiments may be implemented.

Before one or more embodiments of the present disclosure are described in detail, one skilled in the art will appreciate that the present disclosure are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF THE ENABLING EMBODIMENT

Example embodiments will now be described more fully with reference to the accompanying drawings. In general, the subject embodiments are directed to apparatuses and methods for converting a foldable arcade-type device to a multi-game foldable arcade-type device are provided herein. In this detailed description, for purposes of explanation, numerous specific details are set forth to provide a thorough understanding of embodiments of the present invention. One skilled in the art will appreciate, however, that embodiments of the present invention may be practiced without these specific details. In other instances, structures and devices are shown in block diagram form. Furthermore, one skilled in the art can readily appreciate that the specific sequences in which methods are presented and performed are illustrative and it is contemplated that the sequences can be varied and remain within the spirit and scope of embodiments of the present invention.

Three in One Home Arcade-Type Game

As described above, because of the popularity of various sports, many people enjoy sports either as a participant or as a spectator. Unfortunately, most sports are played outdoors on large playing fields or at large indoor facilities. Heretofore, the ability to take aspects of many sports games indoors has been impractical and space prohibitive for most families.

Due to the popularity of sports games and the skill involved to play such games well, games derivative from sports such as basketball, football, baseball, and softball have developed. Games to test a player's basketball shooting or ball-tossing skills are among the most popular at amusement parks, carnivals, and fairs. In more recent years, there has been a trend to scale down the size of such sports games so that the game could move indoors into arcades.

Although arcade games of this type have been used in homes, generally such arcade sports games are not found within a home. This is because, heretofore, such arcade-style game devices were not intended for and do not address the limitations presented by home-usage.

One known device that does address the limitations presented by home-usage is the Exemplary Device, which is described above. This device is adaptable for indoor home-usage while still providing an arcade-type game.

Unfortunately, however, the Exemplary Device is useful for only one type of sport or game. As a result, apparatuses and methods are needed for converting an arcade-type game device to a multi-game or multi-sports device.

Although the prior art includes apparatus for converting an arcade-type game device to a multi-game or multi-sports device, the majority of these arcade-type game devices require significant changes to the original game device or significantly more parts. As a result, additional apparatuses and methods are needed to conveniently convert an arcade-type game device to a multi-game or multi-sports device by applying a minimal number of changes to the device and using a minimal amount of additional parts.

In various embodiments, a device, such as the Exemplary Device, is converted to a multi-game or multi-sports device. The device is converted by applying a minimal number of changes to the device and using a minimal amount of additional parts.

Specifically, in various embodiments, the Exemplary Device is adapted to further include a second goal assembly for a bean bag toss game. The second goal assembly is attached to or made part of the ball return chute.

Figure 4:
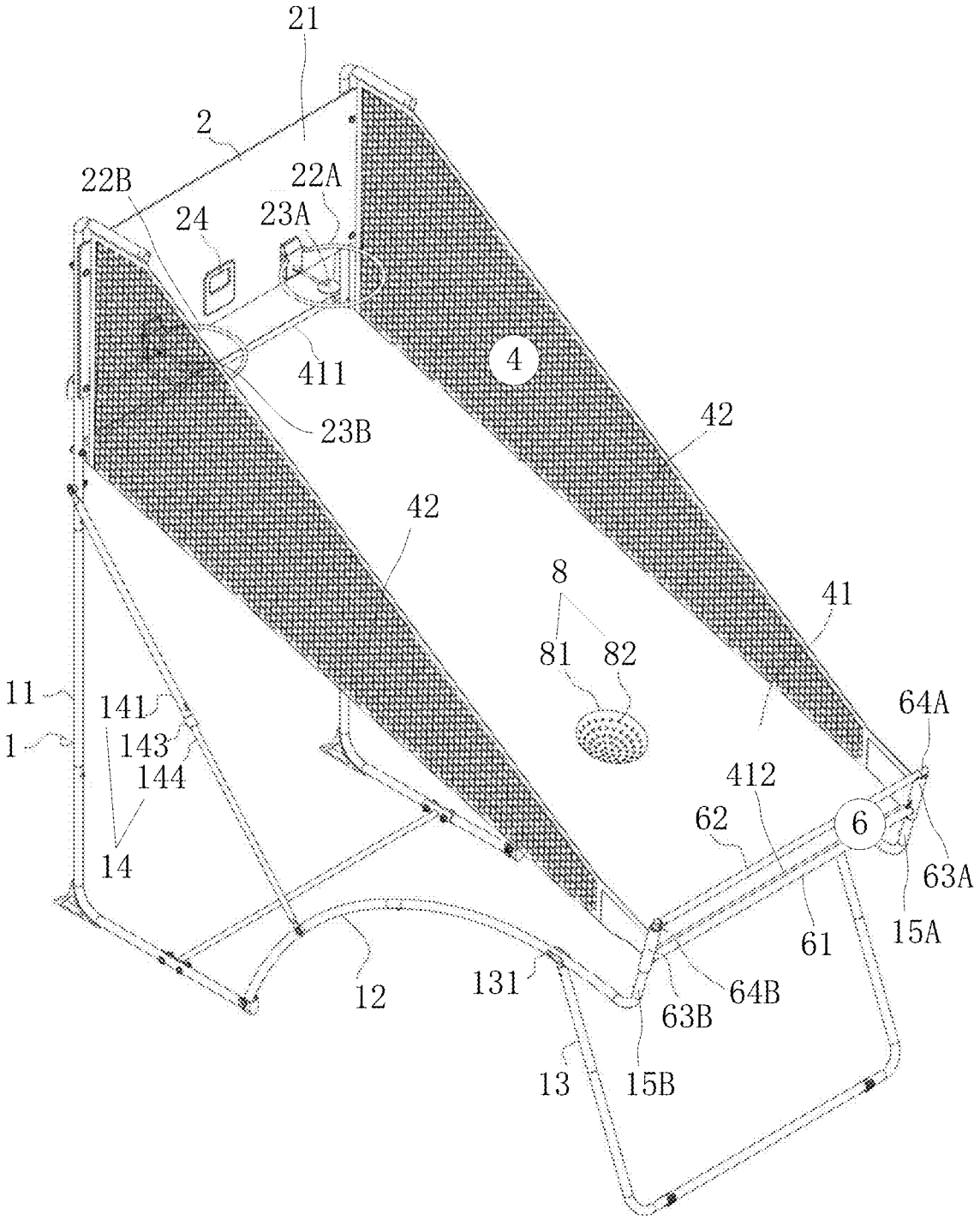
FIG. 4 is a perspective view of a foldable multi-game arcade-type apparatus that includes a bean bag toss goal assembly, in accordance with various embodiments.

FIG. 4 is a perspective view 400 of a foldable multi-game arcade-type apparatus that includes a bean bag toss goal assembly, in accordance with various embodiments. The foldable multi-game arcade-type apparatus of FIG. 4 includes framework 1, first goal assembly 2, ball return chute 4, and second goal assembly 8.

The first goal assembly 2 is attached to a support portion 11 of the framework 1. The first goal assembly 2 receives balls tossed by a user in a first game. As shown in FIG. 4, the first goal assembly 2 is a multi-player basketball goal assembly. The goal assembly 2 includes a backboard 21, a pair of baskets 22A and 22B, a pair of ball sensors 23A and 23B, and an opening for a scoring device and scoreboard 24. During a game, basketballs are thrown toward baskets 22A and 22B. The scoring device and scoreboard tally scores or counts made shots from the ball sensors 23A and 23B. Two baskets 22A and 22B and the ball sensors 23A and 23B allow head-to-head competition.

In various alternative embodiments, first goal assembly 2 can be any type of ball-tossing goal assembly including, but not limited to, a goal assembly for football, baseball, softball, or lacrosse.

The ball return chute 4 includes a bed 41 and a pair of sidewalls 42 for collecting balls from first goal assembly 2 and returning the collected balls to the user. A first end 411 of the ball return chute 4 is attached to the support portion 11 of the framework 1. A second end 412 of the ball return chute 4 is attached to the foldable portion of the framework 1.

The second goal assembly 8 is attached to or is made part of the bed 41 of the ball return chute 4. The second goal assembly 8 may receive bean bags tossed by the user in a second bean bag game.

In various embodiments, the second goal assembly 8 includes a hole 81 in the bed 41. For example, the bed 41 can be a material, but is not limited to, a foldable cloth, plastic, or netting, and the hole 81 is a hole in that material. The hole 81 may be made large enough to accept bean bags.

In various embodiments, the second goal assembly 8 further includes a container 82 attached to the hole 81 for collecting bean bags received by the hole 81 in the second bean bag toss game.

In FIG. 4, a container 82 is shown that may be, for example, as a rigid container. In various alternative embodiments, the container 82 may be, but is not limited to, a foldable pocket made of cloth, plastic, or netting.

In various embodiments, the width of hole 81 is smaller than the width of the maximum cross-sectional area of a ball used and/or the hoops or holes in the first game so that the hole 81 does not interfere with the ball return functionality of the first game. For example, the hole 81 is smaller than a width of a basketball or hoop so that the hole 81 does not interfere with the return of the basketball in the first game. In various alternative embodiments, the second goal assembly 8 can include a moveable cover (not shown) that is closed for the first game, preventing interference with ball return, and opened for the second game that may be different than the first game.

In various embodiments, the foldable multi-game arcade-type apparatus of FIG. 4 further includes a rectangular front-end frame 6 that is adapted for use with a third ladder toss game. The rectangular front-end frame 6 is attached to the foldable portion of the framework 1. The rectangular front-end frame 6 includes a lower cross member 61 that attaches to the bed 41 at a second end 412 of the ball return chute 4. The lower cross member 61 is, for example, threaded through a sleeve of bed 41. The rectangular front-end frame 6 also includes a moveable upper cross member 62 that can move with respect to the lower cross member 61. The moveable upper cross member 62 can move to at least two different positions thereby increasing or decreasing the height of the rectangular front-end frame 6 while still maintaining its rectangular shape.

In a first lower position of the at least two different positions, the moveable upper cross member 62 stops the returning balls of the first game at second end 412 of the ball return chute 4. In a second higher position of the at least two different positions, the moveable upper cross member 62 acts as part of a third goal assembly for ladder balls tossed in a third ladder toss game. In various embodiments, the higher position may include a height larger than a maximum cross-section of a basketball (e.g., a standard size and/or otherwise dependent on hoop) or hoop. In various embodiments, the higher position may include a height smaller than the maximum cross-section of a basketball (e.g., a standard size and/or otherwise dependent on hoop) or hoop U.S. Pat. No. 5,312,099 (hereinafter the "'099 Patent") discloses a basketball return apparatus that includes a ball return chute. The apparatus includes a front-end frame formed by a pair of laterally spaced front corner posts connected by upper and lower front cross members. A vertically adjustable defense bar is mounted in the top ends of the front corner posts and forms a shot barrier over which a basketball must be shot. The defense bar may be adjusted vertically to accommodate the height of a player using the apparatus. In other words, the '099 Patent discloses a vertically adjustable defense bar above a rectangular front-end frame.

The apparatus of the '099 Patent does not include a moveable upper cross member that, in a first lower position, stops the returning balls of a first game and, in a second higher position, acts as part of a third goal assembly for ladder balls tossed in a third ladder toss game. The apparatus of the '099 Patent also does not include a moveable upper cross member that forms a rectangular front-end frame with a lower cross member that attaches to one end of a ball return chute and forms rectangular front-end frame without another cross members between the upper cross member and the lower cross member, as disclosed herein.

Figure 5:
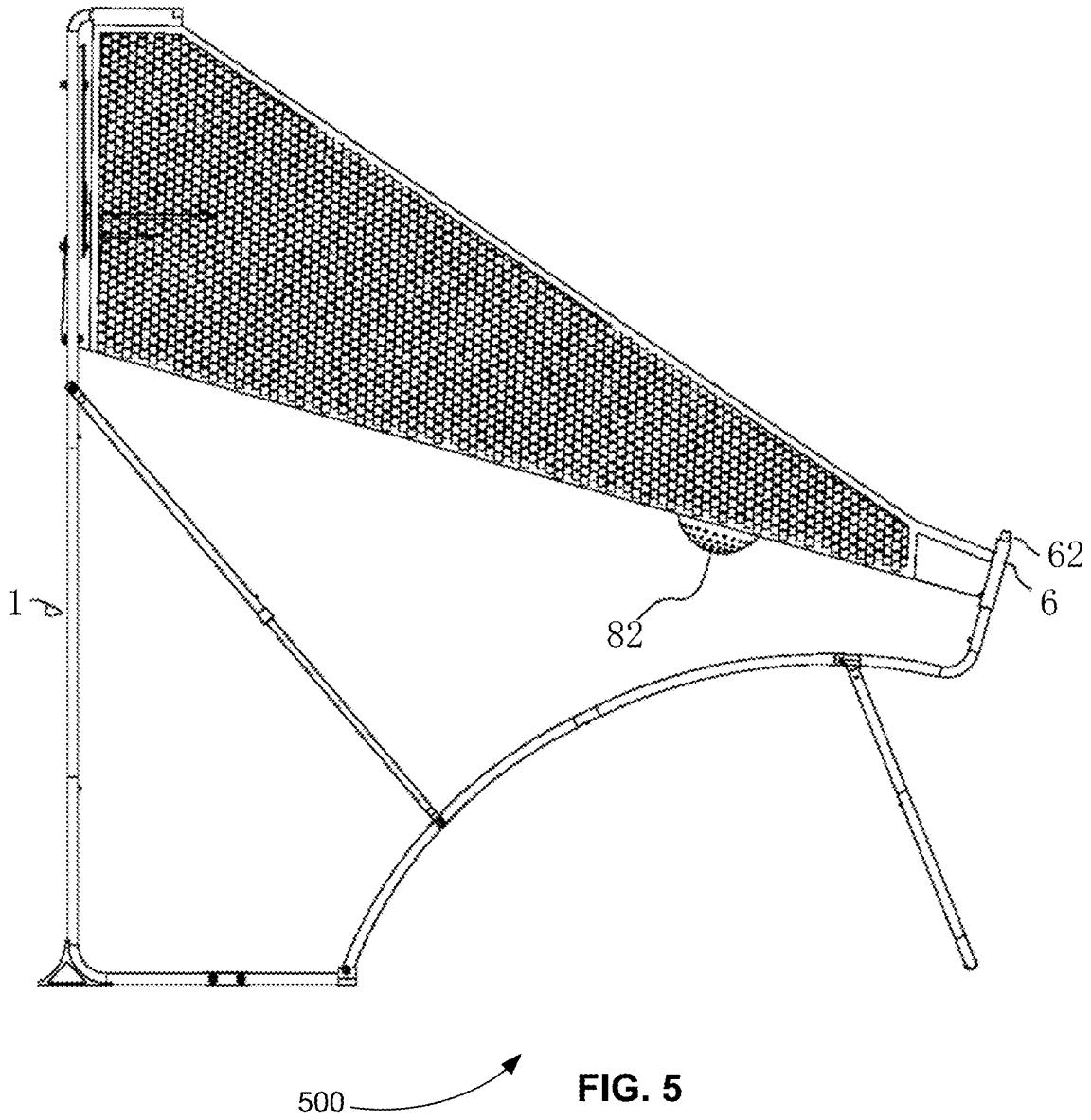
FIG. 5 is a side view of the foldable multi-game arcade-type apparatus of FIG. 4 showing the upper cross member of the rectangular front-end frame in a first lower position, in accordance with various embodiments.

FIG. 5 is a side view 500 of the foldable multi-game arcade-type apparatus of FIG. 4 showing the moveable upper cross member 62 of the rectangular front-end frame 6 in a first lower position, in accordance with various embodiments. In this position, the moveable upper cross member 62 stops or collects the returning balls of the first basketball game, for example. The rectangular front-end frame 6 is attached to framework 1. FIG. 5 further shows the container 82, which is used in the second bean bag toss game.

Figure 6:
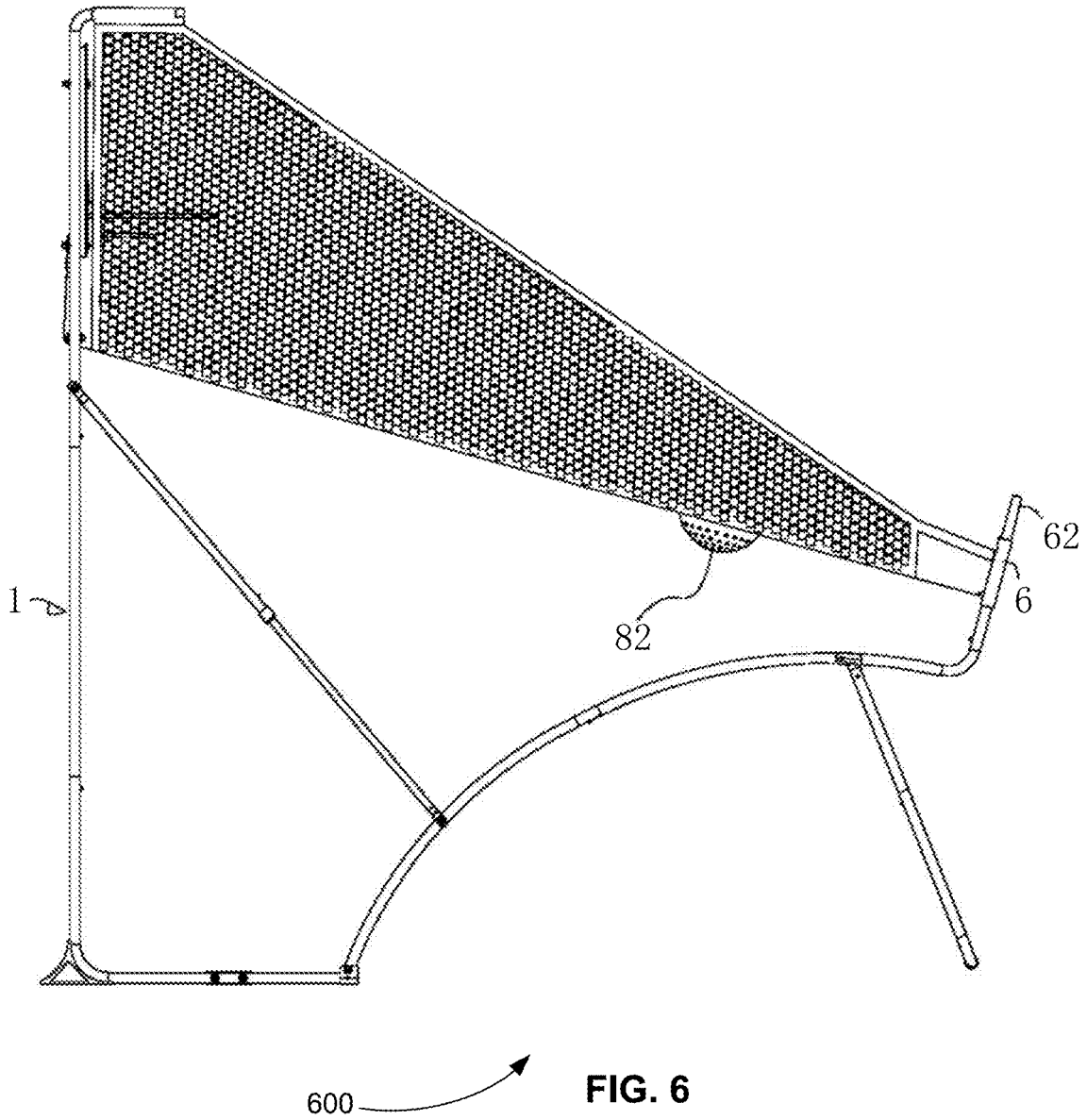
FIG. 6 is a side view of the foldable multi-game arcade-type apparatus of FIG. 5 showing the upper cross member of the rectangular front-end frame in a second higher position than it is shown in FIG. 5, in accordance with various embodiments.

FIG. 6 is a side view 600 of the foldable multi-game arcade-type apparatus of FIG. 5 showing the moveable upper cross member 62 of the rectangular front-end frame in a second higher position than it is shown in FIG. 5, in accordance with various embodiments. In this position, the moveable upper cross member 62 acts as part of a third goal assembly for ladder balls tossed in a third ladder toss game. Again, the rectangular front-end frame 6 is attached to the framework 1. FIG. 6 further shows a container 82, which is used in the second bean bag toss game.

Returning to FIG. 4, in various embodiments, the rectangular front-end frame 6 further includes a first tee joint 63A, a second tee joint 63B, a first telescoping side tube 64A, and a second telescoping side tube 64B. The rectangular front-end frame 6 is formed by connecting a first end of the first telescoping side tube 64A to one end of the moveable upper cross member 62 and connecting a first end of second telescoping side tube 64B to another end of the moveable upper cross member 62. Further, a middle opening of first tee joint 63A is connected to one end of lower cross member 61 and a middle opening of second tee joint 63B is connected to another end of lower cross member 61. Finally, a second end of first telescoping side tube 64A is slid into a first end opening of the first tee joint 63A and a second end of the second telescoping side tube 64B is slid into a first end opening of the second tee joint 63B.

In various embodiments, rectangular front-end frame 6 is connected to the foldable portion of framework 1. Specifically, a second end opening of the first tee joint 63A is connected to a first connecting tube 15A of the foldable portion and a second end opening of second tee joint 63B is connected to a second connecting tube 15B of the foldable portion. In various embodiments, the first telescoping side tube 64A can also slide into first connecting tube 15A and the second telescoping side tube 64B can also slide into the second connecting tube 15B.

The first connecting tube 15A and the second connecting tube 15B are each connected to the support portion 11 of framework 1 through one of two curved supports 12. The foldable portion also includes two telescopic poles 14 and a U-shaped extendable leg 13 connected to each curved support 12 through a joint 131. Each of telescopic poles 14 includes a support pole 141, a joint 143, and a sliding pole 144 that slides into joint 143.

In various embodiments, the first telescoping side tube 64A and the second telescoping side tube 64B each include at least one detent (not shown) for maintaining the moveable upper cross member 62 in the second higher position for the third game. Each detent of the first telescoping side tube 64A and the second telescoping side tube 64B can engage, for example, one or more holes of the first tee joint 63A and the second tee joint 63B, respectively, or one or more holes of the first connecting tube 15A and the second connecting tube 15B, respectively.

Figure 7:
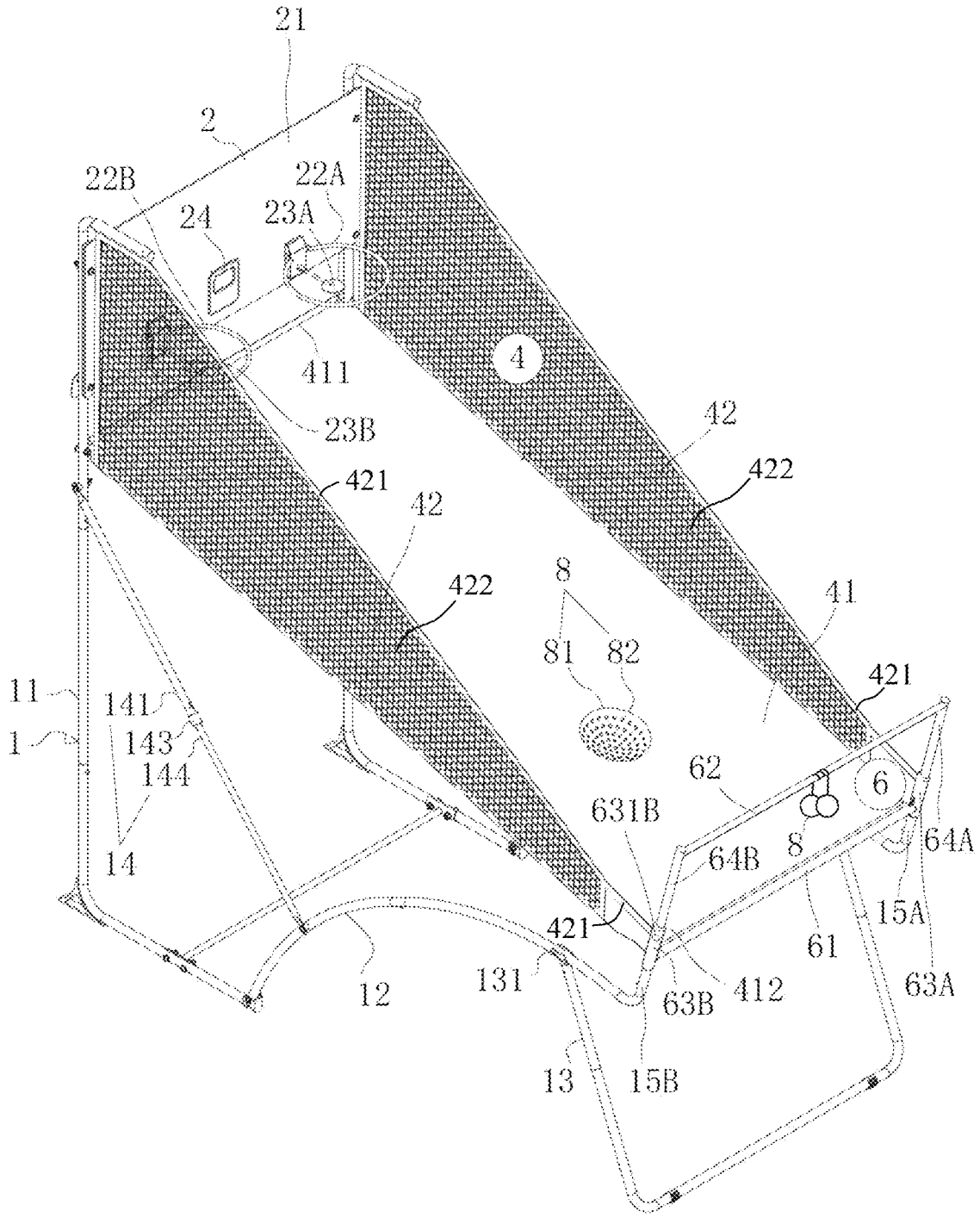
FIG. 7 is a perspective view of the foldable multi-game arcade-type apparatus of FIG. 4 showing the upper cross member of the rectangular front-end frame in a second higher position than it is shown in FIG. 4, in accordance with various embodiments.

FIG. 7 is a perspective view 700 of the foldable multi-game arcade-type apparatus of FIG. 4 showing the moveable upper cross member 62 of the rectangular front-end frame 6 in a second higher position than it is shown in FIG. 4, in accordance with various embodiments. In this position, the moveable upper cross member 62 acts as part of a third goal assembly for ladder balls 8 tossed in a third ladder toss game. Note that the second tee joint 63B includes a hole 631B for accepting a button of a detent of the second telescoping side tube 64B in order to maintain the moveable upper cross member 62 in the second higher position.

The rectangular front-end frame 6 includes the lower cross member 61, the first tee joint 63A, the second tee joint 63B, the first telescoping side tube 64A, and the second telescoping side tube 64B. Additionally, the rectangular front-end frame 6 is connected to the foldable portion of framework 1 using a first connecting tube 15A and a second connecting tube 15B of the foldable portion. The foldable portion includes, but is not limited to, two curved supports 12, two telescopic poles 14, and a U-shaped extendable leg 13 connected to each curved support 12 through a joint 131. Each of the telescopic poles 14 may include a support pole 141, a joint 143, and a sliding pole 144 that slides into joint 143.

The first goal assembly 2 is attached to the support portion 11 of the framework 1. The first goal assembly 2 includes the backboard 21, the baskets 22A and 22B, the ball sensors 23A and 23B, and the opening for a scoring device and scoreboard 24. The ball return chute 4 includes the bed 41 and the sidewalls 42 for collecting balls from the first goal assembly 2 and returning the collected balls to the user in the first game. A first end 411 of the ball return chute 4 is attached to support portion 11 of framework 1. A second end 412 of the ball return chute 4 is attached to the foldable portion of framework 1. As also shown in FIG. 7, each of the sidewalls 42 includes a strap 421 that extends between the support portion 11 and a corresponding one of the first tee joint 63A and the second tee joint 63B. Each of the straps 421 is attached to the corresponding tee joint 63A, 63B, adjacent to an upper end thereof. Each of the each of the sidewalls 42 also includes a netting 422 that extends between the strap 421 and the bed 41.

The second goal assembly 8 is attached to or is made part of the bed 41 of the ball return chute 4. The second goal assembly 8 receives bean bags tossed by the user in a second bean bag game. The second goal assembly 8 further includes the container 82 attached to the hole 81 for collecting bean bags received by the hole 81 in the second bean bag toss game.

Figure 8:
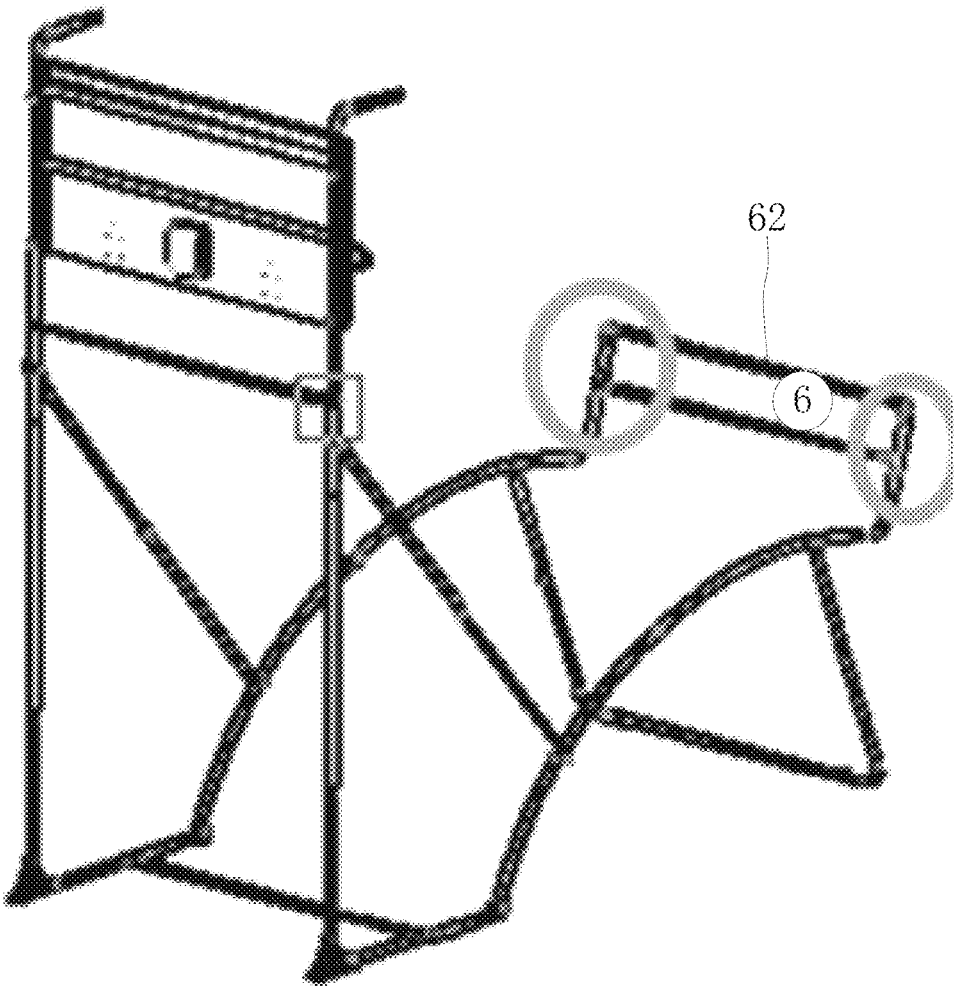
FIG. 8 is a perspective rear view of the framework of the foldable multi-game arcade-type apparatus of FIG. 4 showing the upper cross member of the rectangular front-end frame in a first lower position, in accordance with various embodiments.

FIG. 8 is a perspective rear view 800 of the framework of the foldable multi-game arcade-type apparatus of FIG. 4 showing the upper cross member 62 of the rectangular front-end frame 6 in a first lower position, in accordance with various embodiments. The moveable upper cross member 62 of the rectangular front-end frame 6 is shown in a first lower position for basketball or bean bag play, for example.

Figure 9:
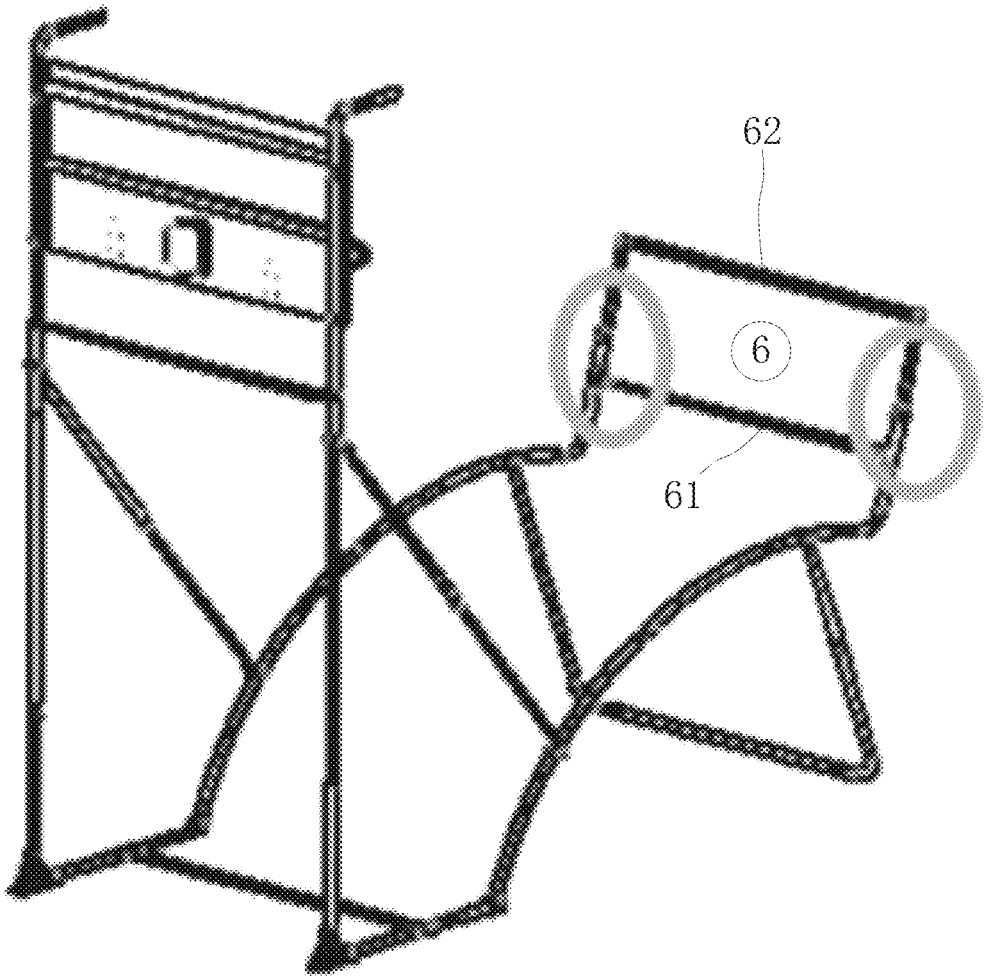
FIG. 9 is a perspective rear view of the framework of the foldable multi-game arcade-type apparatus of FIG. 4 showing the upper cross member of the rectangular front-end frame in a second higher position, in accordance with various embodiments.

FIG. 9 is a perspective rear view 900 of the framework of the foldable multi-game arcade-type apparatus of FIG. 4 showing the upper cross member 62 of the rectangular front-end frame 6 in a second higher position, in accordance with various embodiments. The moveable upper cross member 62 of the rectangular front-end frame 6 is shown in a second higher position for ladder toss play, for example. In various embodiments, there are no other cross members between the moveable upper cross member 62 and the lower cross member 61 of the rectangular front-end frame 6.

Figure 10:
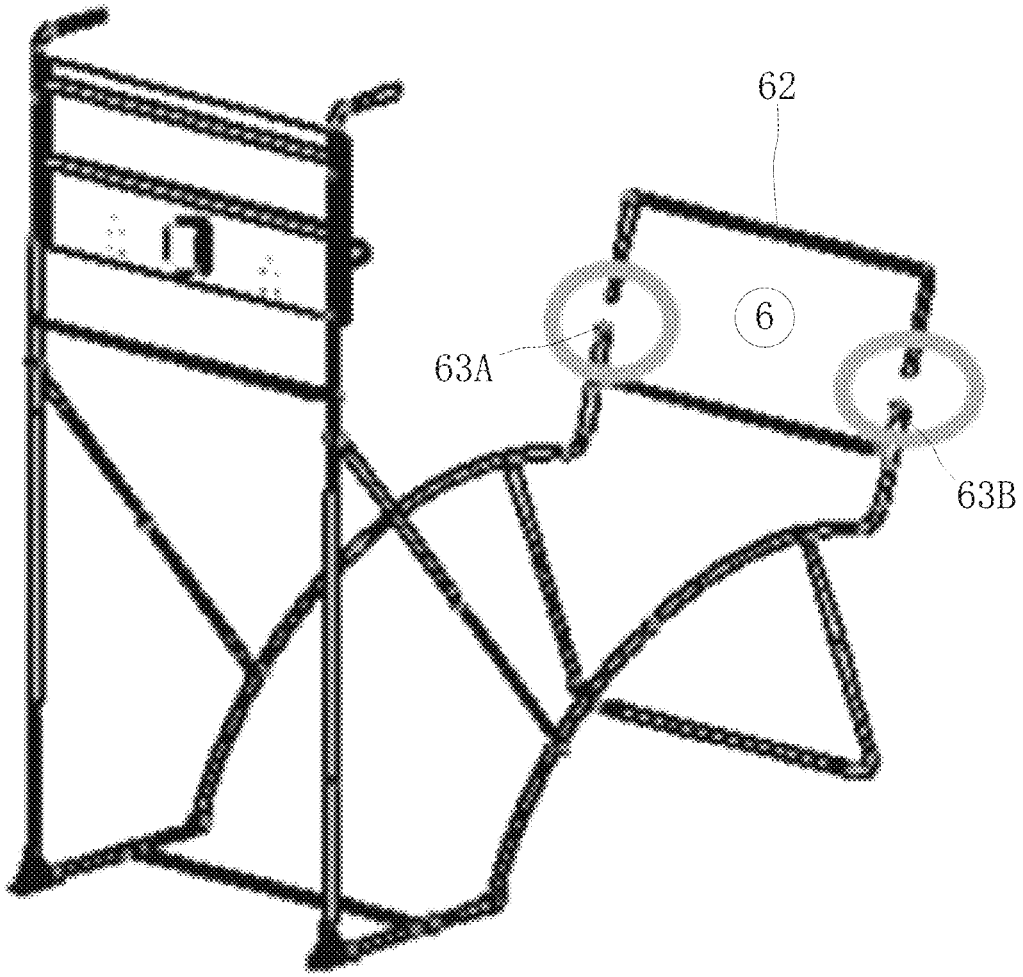
FIG. 10 is a perspective rear view of the framework of the foldable multi-game arcade-type apparatus of FIG. 4 showing the upper cross member of the rectangular front-end frame in a detached position, in accordance with various embodiments.

FIG. 10 is a perspective rear view 1000 of the framework of the foldable multi-game arcade-type apparatus of FIG. 4 showing the upper cross member 62 of the rectangular front-end frame 6 in a detached position, in accordance with various embodiments. The moveable upper cross member 62 of rectangular front-end frame 6 is shown detached from the first tee joint 63A and the second tee joint 63B.

Figure 11:
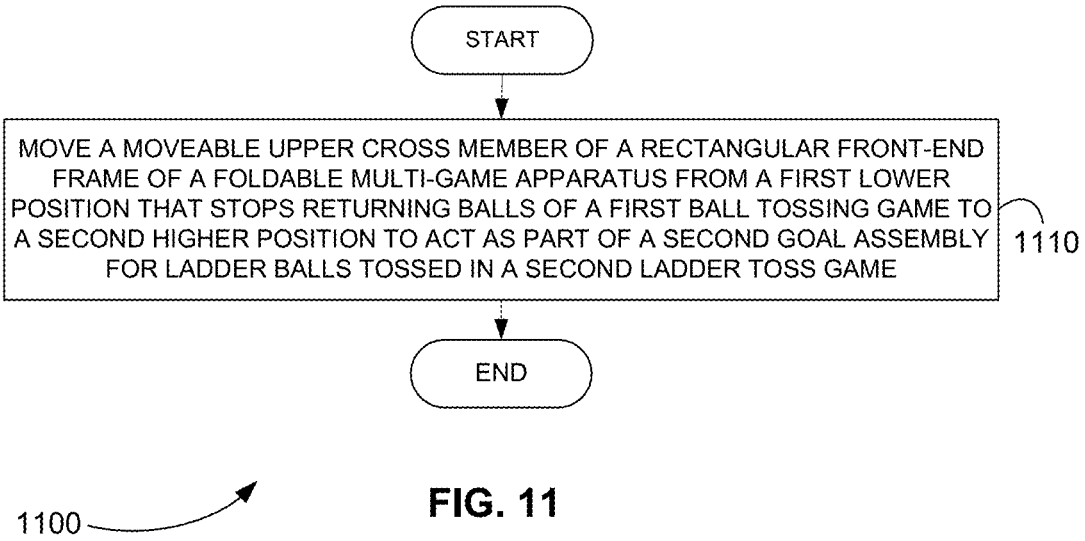
FIG. 11 is an exemplary flowchart showing a method for converting a foldable multi-game apparatus from a ball toss game to a ladder toss game, in accordance with various embodiments.

FIG. 11 is an exemplary flowchart showing a method for converting a foldable multi-game apparatus from a ball toss game to a ladder toss game, in accordance with various embodiments.

At step 1110 of the method, a moveable upper cross member of a rectangular front-end frame of a foldable multi-game apparatus is moved from a first lower position that stops returning balls of a first ball-tossing game to a second higher position to act as part of a second goal assembly for ladder balls tossed in a second ladder toss game.

The foldable multi-game apparatus further includes a framework 1. The framework 1 includes a support portion and a foldable portion. The rectangular front-end frame 6 is attached to the foldable portion. A first goal assembly 22*a* for receiving balls tossed by a user in the first game is attached to the support portion. A ball return chute 4 including a bed 41 and two sidewalls 42 for collecting balls from the first goal assembly 2 and returning the collected balls to the user is attached at a first end 411 of the ball return chute to the support portion and is attached at a second end of the ball return chute 4 to the foldable portion. The rectangular front-end frame 6 further includes a lower cross member 61 that attaches to the bed 41 at the second end 412 of the ball return chute 4. The moveable upper cross member 62 moves with respect to the lower cross member 61 thereby increasing or decreasing the height of the rectangular front-end frame 62 while still maintaining a rectangular shape.

While the present disclosure are described in conjunction with various embodiments, it is not intended that the present disclosure be limited to such embodiments. On the contrary, the present disclosure encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A foldable multi-game apparatus, comprising:

a framework having a support portion and a foldable portion;

a first goal assembly coupled to the support portion including a backboard supporting a first basketball net and a second basketball net for receiving basketballs tossed by a user in a first game of basketball, wherein each of the first basketball net and the second basketball net defines a corresponding vertical plane through a center thereof and perpendicular to the backboard;

a basketball return chute having a bed and two sidewalls for collecting basketballs from the first goal assembly and returning the basketballs to the user, the basketball return chute including a first end coupled to the support portion and a second end coupled to the foldable portion;

a second goal assembly comprising a hole in the bed of the basketball return chute for receiving bean bags in a second game of bean bag toss, wherein the hole in the bed of the basketball return chute is spaced apart from each of the vertical planes, thereby avoiding contact with the basketballs as the basketballs roll along the bed after having passed through a corresponding one of the first basketball net and the second basketball net; and a rectangular front-end frame including a first tee joint, a second tee joint, and a lower cross member extending vertically between the first and second tee joints and holding the bed along a length of the lower cross member, wherein each of the first tee joint and the second tee joint has a generally tubular shape extending perpendicular to the lower cross member, wherein the rectangular front-end frame further includes a movable portion configured to move relative to the lower cross member and between a first position for stopping basketballs at the second end of the basketball return chute, and a second position higher than the first position to serve as a goal for ladder balls tossed in a ladder toss game, the movable portion including a first telescoping side tube, a second telescoping side tube, and an upper cross member extending vertically between the first telescoping side tube and the second telescoping side tube, wherein each of the first telescoping side tube and the second telescoping side tube is sleeved within a corresponding one of the first tee joint and the second tee joint and configured to slide therein between the first position and the second position, wherein each of the two sidewalls includes a strap extending between the support portion and a corresponding one of the first tee joint and the second tee joint, each of the straps attached to the corresponding one of the first tee joint and the second tee joint adjacent to an upper end thereof, and wherein each of the two sidewalls further includes a netting having a top edge attached to the strap, wherein the netting is also attached to the bed.

2. The foldable multi-game apparatus of claim 1, wherein the second goal assembly comprises a container attached to the hole for collecting the bean bags received by the hole in the second game of bean bag toss.

3. The foldable multi-game apparatus of claim 2, wherein the container comprises netting to catch the bean bags.

4. The foldable multi-game apparatus of claim 1, wherein a width of the hole is smaller than a maximum width of a basketball used in the first game of basketball.

5. The foldable multi-game apparatus of claim 1, wherein the first tee joint defines a second end opening connected to a first connecting tube of the foldable portion, and wherein the second tee joint defines a second end opening connected to a second connecting tube of the foldable portion to connect the rectangular front-end frame to the foldable portion of the framework.

6. The foldable multi-game apparatus of claim 1, wherein the first telescoping side tube and the second telescoping side tube each include at least one detent for maintaining the upper cross member in at least one of the first position and the second position.

* * * * *